US005762238A

United States Patent [19]

Liang

[11] Patent Number: 5,762,238

[45] Date of Patent: Jun. 9, 1998

[54] SPRAY BOTTLE

[75] Inventor: Wang Tao Liang, Hong Kong, Hong Kong

[73] Assignee: Hay Nien Company, Ltd., Kowloon, Hong Kong

[21] Appl. No.: 641,786

[22] Filed: May 2, 1996

[30] Foreign Application Priority Data

May 4, 1995 [GB] United Kingdom ..... 9509130

[51] Int. Cl.[6] ..... B05B 11/00; B67D 5/42

[52] U.S. Cl. ..... 222/321.9; 222/321.1; 222/542

[58] Field of Search ..... 222/320, 321.1, 222/321.7, 321.9, 542, 385, 383.1, 372

[56] References Cited

U.S. PATENT DOCUMENTS

| | | | |
|---|---|---|---|
| 3,161,329 | 12/1964 | Fedit et al. | 222/542 X |
| 3,191,815 | 6/1965 | Graham et al. | 222/542 X |
| 3,223,292 | 12/1965 | Keeney et al. | 222/321.9 |
| 3,463,093 | 8/1969 | Pfeiffer et al. | 222/321.9 X |
| 3,581,958 | 6/1971 | Meshberg | 222/542 |
| 4,216,883 | 8/1980 | Tasaki et al. . | |
| 4,503,996 | 3/1985 | Sorm et al. | 222/321.9 |
| 4,773,553 | 9/1988 | Van Brocklin | 222/321.9 X |
| 4,984,702 | 1/1991 | Pierpont | 222/321.7 X |
| 5,012,970 | 5/1991 | Kucherer | 222/321.7 X |
| 5,069,369 | 12/1991 | McGarvey | 222/542 X |
| 5,108,013 | 4/1992 | VanBrocklin | 222/542 X |
| 5,299,703 | 4/1994 | Cater | 222/321.7 X |
| 5,348,174 | 9/1994 | Velicka . | |

FOREIGN PATENT DOCUMENTS

| | | | |
|---|---|---|---|
| 0461771 A2 | 12/1891 | European Pat. Off. . | |
| 2003974 | 3/1979 | United Kingdom . | |
| 1590267 | 5/1981 | United Kingdom . | |
| 2111606 | 7/1983 | United Kingdom | 222/321.9 |

*Primary Examiner*—Kevin F. Shaver
*Attorney, Agent, or Firm*—Gunn, Lee & Miller, P.C.

[57] ABSTRACT

A spray bottle which comprises a bottle body having a mouth around which an annular groove is formed and a spraying pump having a stem located through the mouth of the bottle body for pumping up and spraying out liquid contained in the bottle body. The spraying pump includes a press-knob incorporating a spraying nozzle provided at an upper end of the stem and a cap provided co-axially around the stem for locating the overall spraying pump in position upon fitting over the mouth. An O-ring is located in the annular groove for engagement with an inner side of the cap for sealing.

5 Claims, 1 Drawing Sheet

SPRAY BOTTLE

The present invention relates to a spray bottle for containing, particularly but not exclusively, perfume or toiletries.

SUMMARY OF THE INVENTION

According to the invention, there is provided a spray bottle which comprises a bottle body having a mouth around which an annular groove is formed, a spraying pump having a stem located through the mouth of the bottle body for pumping up and spraying out liquid contained in the bottle body, said spraying pump including a press-knob incorporating a spraying nozzle provided at an upper end of the stem and a cap provided co-axially around the stem for locating the overall spraying pump in position upon fitting over the mouth, and an O-ring located in the annular groove for engagement with an inner side of the cap for sealing.

Preferably, the cap has a skirt bearing the cap inner side, said skirt being held in position by an external sleeve disposed co-axially around the cap.

More preferably, the skirt has a flared bottom periphery which is closed by the sleeve to engage from below the mouth.

In a preferred embodiment, at least one small air vent is provided through the cap at a position above the mouth.

The spray bottle may be used for containing perfume or toiletries.

BRIEF DESCRIPTION OF DRAWINGS

The invention will now be more particularly described, by way of example only, with reference to the accompanying drawings, in which.

DETAILED DESCRIPTION OF PREFERRED EMBODIMENT(S)

Figure 1:
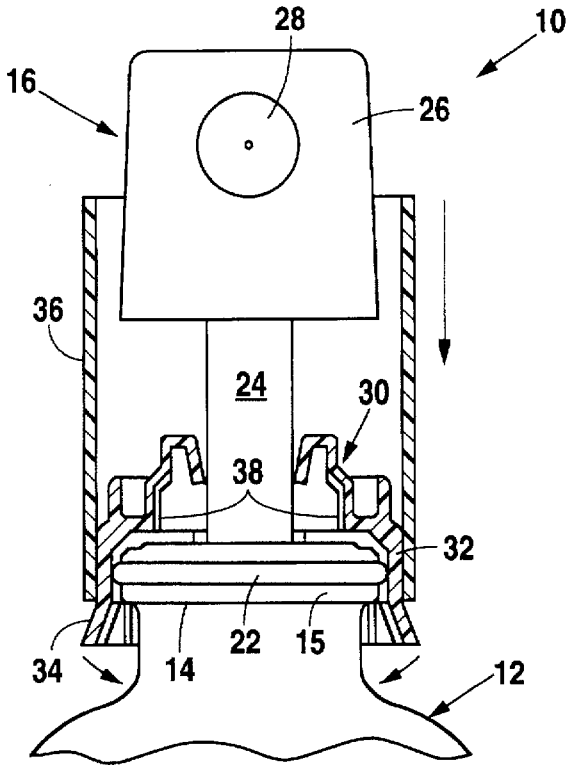
FIG. 1 is a fragmentary partially-sectioned side view of an embodiment of a spray bottle in accordance with the invention.
Figure 2:
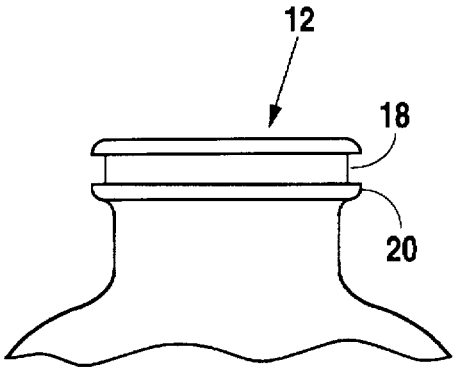
FIG. 2 is a fragmentary side view of a bottle body of the spray bottle of FIG. 1.

Referring firstly to FIGS. 1 and 2 of the drawings, there is shown a spray bottle 10 embodying the invention, which spray bottle 10 comprises a rigid plastic bottle body 12 and a spraying pump 16. The bottle body 12 has a circular mouth 14 which is slightly radially-expanded to form an annular lip 15. The lip 15 bears an annular groove 18 on its outer side 20, in which groove 18 an O-ring 22 is disposed around. The O-ring 22 may be of rubber or cork or the like material. The spraying pump 16 is located vertically through the mouth 14.

The spraying pump 16 has a plastic stem 24, a press-knob 26 carrying a spray nozzle 28 supported on the upper end of the stem 24, and a semi-rigid plastic cap 30 provided co-axially around the stem 24. Although this is not shown in the drawings, the stem 24 extends co-axially upwards from the upper end of a plastic pump cylinder in which a compression coil spring is housed. The lower end of the stem 24 terminates in the form of a piston which cooperates with the pump cylinder to provide a pumping action. The coil spring urges the stem 24 and hence the press knob 26 upwards into a rest uppermost position. A flexible plastic tube extends downwards from the lower end of the pump cylinder to a position near the bottom of the bottle body 12, reaching into liquid contained in the bottle body 12.

In operation, as generally known in the art, the stem 24 (press-knob 26) moves upwards, under the action of the coil spring, to draw the liquid into the pump cylinder through the tube. Upon pressing of the press-knob 26, the stem 24 moves downwards to expel the liquid held inside the pump cylinder further up through the stem 24 itself, which liquid is then discharged through the nozzle 28 in the form of a spray. The spraying pump 16 includes internal one-way valves to control the travel of liquid, in a generally known manner which, for simplicity, will not be described herein.

The cap 30 is fixed on and around the upper end of the pump cylinder, and serves to locate the overall spraying pump 16 in position upon fitting over the mouth 14. The cap 30 has a generally cylindrical side skirt 32 which is deformable and has a flared bottom periphery 34. When the cap 30 is push-fitted over the bottle mouth 14, the skirt 32 engages with its inner side against the O-ring 22, thereby sealing the engagement between the cap 30 and the bottle body 12. The cap 30 is preferably locked in position by an external cylindrical sleeve 36 which is pushed co-axially downwards to tightly surround the entire cap 30, thereby closing the bottom periphery 34 of the skirt 32 to engage from below the mouth lip 15. Upon closing of the bottom periphery 34, the whole cap 30 is slightly stretched downwards.

It is envisaged that the O-ring 22 may be initially provided on the inner side of the skirt 32 of the cap 30, instead of on the bottle mouth 14.

A pair of small slits/holes 38 is formed on opposite sides of the cap 30 at positions directly over the wall of the bottle mouth 14, which serve as air vents to permit balance of pressure between the interior and the exterior of the spray bottle 10.

Figure 3:
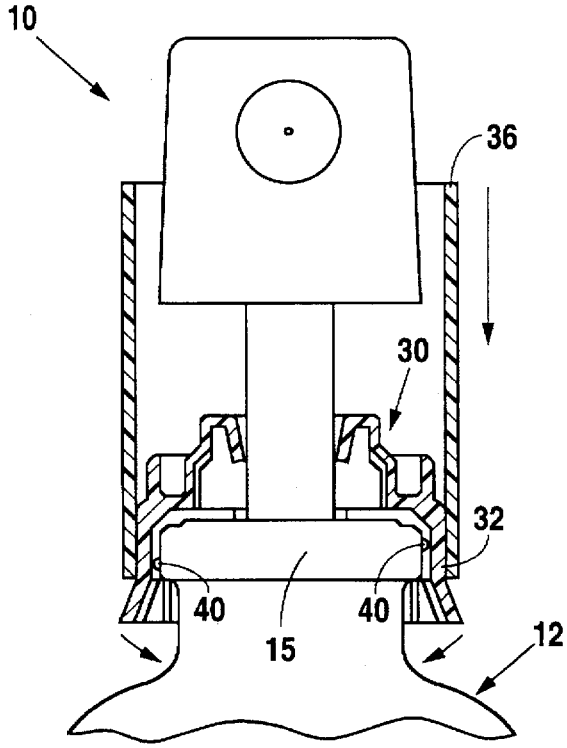
FIG. 3 is a fragmentary partially-sectioned side view of the spray bottle of FIG. 1, without the use of an O-ring.

Reference is finally made to FIG. 3 of the drawings. Without the use of the O-ring 22, the annular groove 18 is no longer necessary and therefore absent. The cap 30 is made suitably smaller, with the skirt 32 having a slightly reduced diameter to enable its inner side to fit around and directly against the mouth lip 15 of the bottle body 12. A correspondingly smaller sleeve 36 is used to lock the cap 30 in position, as previously described.

In practice, due to certain inherent mismatch between mould halves, the surface of a moulded article formed over the mould joint cannot be made perfect or sufficiently smooth to provide a sound sealing surface. This may happen to the outer surface of the mouth lip 15, thereby resulting in the formation of protruding irregularities or flashes 40 along the mould parting line. Such flashes 40 may render any direct sealing between the cap 30 and the bottle body 12 ineffective. The use of the O-ring 22 solves this problem.

The invention has been given by way of example only, and various modifications of and/or alterations to the described embodiment may be made by persons skilled in the art without departing from the scope of the invention as specified in the appended claims.

What is claimed is:

1. A spray bottle comprising a bottle body having a mouth around which an annular groove is formed, a spraying pump having a stem located through the mouth of the bottle body for pumping up and spraying out liquid contained in the bottle body, said spraying pump including a press-knob incorporating a spraying nozzle provided at an upper end of the stem and a cap provided co-axially around the stem for locating the overall spraying pump in position upon fitting over the mouth, and an O-ring located in the annular groove for engagement with an inner side of the cap for sealing.

2. A spray bottle as claimed in claim 1, wherein the cap has a skirt bearing the cap inner side, said skirt being held in position by an external sleeve disposed co-axially around the cap.

3. A spray bottle as claimed in claim 2, wherein the skirt has a flared bottom periphery which is closed by the sleeve to engage from below the mouth.

4. A spray bottle as claimed in claim 1, wherein at least one small air vent is provided through the cap at a position above the mouth.

5. A spray bottle as claimed in claim 1, being for containing perfume or toiletries.

* * * * *